US006062041A

United States Patent [19]

Kikkawa et al.

[11] Patent Number: 6,062,041

[45] Date of Patent: May 16, 2000

[54] METHOD FOR LIQUEFYING NATURAL GAS

[75] Inventors: Yoshitsugi Kikkawa; Osamu Yamamoto; Moritaka Nakamura; Shigeru Sugiyama; Yasuharu Fukuda, all of Yokohama, Japan

[73] Assignee: Chiyoda Corporation, Japan

[21] Appl. No.: 08/974,824

[22] Filed: Nov. 20, 1997

[30] Foreign Application Priority Data

Jan. 27, 1997 [JP] Japan ..... 9-012670

[51] Int. Cl.[7] ..... F25J 1/00

[52] U.S. Cl. ..... 62/613; 62/619

[58] Field of Search ..... 62/612, 613, 618, 62/619, 912

[56] References Cited

U.S. PATENT DOCUMENTS 3,735,600 5/1973 Dowdell et al. ..... 62/619
4,970,867 11/1990 Herron et al. ..... 62/613
5,363,655 11/1994 Kikkawa et al. ..... 62/613
5,414,188 5/1995 Ha et al. ..... 62/619 X
5,537,827 7/1996 Low et al. ..... 62/613
5,651,269 7/1997 Prevost et al. ..... 62/613

*Primary Examiner*—Ronald Capossela
*Attorney, Agent, or Firm*—Lorusso & Loud

[57] ABSTRACT

Provided is a method for liquefying natural gas which can be applied to LNG plants of a wide range of capacity and can produce LNG both efficiently and economically. Feed gas of natural gas or a non-liquefied component of recycle gas which is produced during a process of liquefying natural gas is liquefied by using a first refrigerant, for instant consisting of a C3 refrigerant, and a second refrigerant which is different from the first refrigerant, for instance consisting of a C2 refrigerant, in a stepwise fashion. The flow is then liquefied by a substantially isentropic expansion process. The non-liquefied component remaining from this expansion process is then pressurized by a compressor, and combined with the non-liquefied component of the natural gas for recycling the combined flow. The compressor is driven by power obtained from the substantially isentropic expansion process.

16 Claims, 8 Drawing Sheets

METHOD FOR LIQUEFYING NATURAL GAS

TECHNICAL FIELD

The present invention relates to a method for liquefying natural gas, and in particular to a method for liquefying natural gas which can be applied to LNG plants of a wide range of capacity and can produce LNG both economically and efficiently.

BACKGROUND OF THE INVENTION

Currently, the propane-precooled mixed-refrigerant process developed by Air Products of the United States and the Tealarc process developed by Technip of France are widely used as the liquefaction processes for base load LNG plants. These two processes rely on the use of extremely large Hampson heat exchangers, but Hampson heat exchangers can be constructed only in plants equipped with special facilities, and are therefore expensive and require long periods of time to manufacture. Therefore, the need for such heat exchangers contributed to the increase in the costs for constructing LNG plants and the difficulty in enlarging existing LNG plants.

The applicants have therefore previously proposed a method for liquefying natural gas which minimizes the requirement of such expensive and special heat exchangers, and can be readily applied to LNG plants of a wide range of capacity in U.S. Pat. No. 5,363,655 issued Nov. 15, 1994. However, according to this method for liquefying natural gas, because the temperature range in the precooling unit is relatively wide, the refrigerant is required to have a large number of components, and the facility for producing the refrigerant tends to be costly. In particular, if the natural gas field produces little of a C5 fraction, the refrigerant cannot be produced within the LNG plant.

BRIEF SUMMARY OF THE INVENTION

In view of such problems of the prior art, a primary object of the present invention is to provide a method for liquefying natural gas which can be applied to LNG plants of a wide range of capacity, and can be carried out both efficiently and economically.

A second object of the present invention is to provide a method for liquefying natural gas which can be carried out by using inexpensive heat exchangers such as shift and tube heat exchangers instead of expensive Hampson type heat exchangers.

A third object of the present invention is to provide a method for liquefying natural gas which does not require the refrigerant to contain a large number of components, and in particular which does not require the refrigerant to contain a C5 fraction.

According to the present invention, such objects can be accomplished by providing a method for liquefying natural gas, comprising the steps of: cooling a high temperature portion of natural gas given as a feed gas by using a single-component refrigerant or a mixed refrigerant, and liquefying a low temperature portion of the natural gas with a substantially isentropic expansion process; and pressurizing a non-liquefied fraction of the natural gas by using a compressor and recycling the non-liquefied fraction so that a high temperature portion of the non-liquefied fraction may be cooled by using a single-component refrigerant or a mixed refrigerant similarly as the previous step, and a low temperature portion of the non-liquefied fraction may be liquefied with a substantially isentropic expansion process, the compressor being driven by power obtained by the substantially isentropic expansion process; cooling of the high temperature portion using the refrigerant being carried out in a step-wise fashion by using a first refrigerant and a second refrigerant. Typically, the cooling of the high temperature portion of the natural gas by the refrigerant results in a partial liquefaction of the natural gas. The high and low temperature portions of the natural gas mentioned above are here understood as denoting a relatively high temperature portion, for instance, in the range of room temperature to approximately−80° C., and a relatively low temperature portion, for instance, in the range temperature to −160° C. for liquefaction.

FIG. 8 schematically illustrates the refrigeration process according to the present invention in comparison with the conventional propane-precooled mixed-refrigerant process. According to the present invention, first of all, the natural gas is cooled to approximately −30° C. by using the first refrigerant. This is similar to the conventional precooling process using the propane refrigerant (C3R). Conventionally, the natural gas is further cooled by using the mixed refrigerant (MR) until the natural gas is substantially entirely liquefied (−160° C.). According to the present invention, the natural gas is cooled to approximately −100° C. by using the second refrigerant, and is then further cooled to −160° C. by using an expander. However, it should be understood that the temperature levels given in the graph of FIG. 8 should be understood merely as exemplary, and may be changed for each particular application without departing from the spirit and concept of the present invention.

The first refrigerant preferably consists of a single-component propane or propylene refrigerant or a mixed refrigerant essentially consisting of any combination of refrigerants selected from a group consisting of ethane, ethylene, propane and propylene so that the feed gas of natural gas can be cooled to a temperature range of −30° C. to −40° C. The second refrigerant preferably consists of a single-component ethane or ethylene refrigerant or a mixed refrigerant essentially consisting of any combination of low temperature fraction hydrocarbons selected from a group consisting of methane, ethane, ethylene, propane and propylene so that the feed gas of natural gas can be cooled to a temperature range of −70° C. to −100° C.

The present invention further provides a method for liquefying natural gas, comprising the steps of: cooling a high temperature portion of natural gas given as a feed gas by using a single-component refrigerant or a mixed refrigerant, and liquefying a low temperature portion of the natural gas with a substantially isentropic expansion process; pressurizing a non-liquefied fraction of the natural gas by using a compressor and recylcling the non-liquefied fraction so that a high temperature portion of the non-liquefied fraction may be cooled by using a single-component refrigerant or a mixed refrigerant similarly as the previous step, and a low temperature portion of the non-liquefied fraction may be liquefied with a substantially isentropic expansion process, the compressor being driven by power obtained by the substantially isentropic expansion process; and pressurizing a non-liquefied fraction of the recycle natural gas remaining after the last expansion process to combine the thus pressurized non-liquefied fraction with the remaining non-liquefied fraction of the recycle natural gas for recycling; cooling of the high temperature portion using the refrigerant being carried out in a step-wise fashion by using a first refrigerant and a second refrigerant.

The non-liquefied fraction remaining after the cooling process by the second refrigerant is liquefied by a substantially isentropic expansion process, and the non-liquefied fraction remaining after the expansion process is pressurized by a compressor for recycling. The power obtained from the substantially isentropic expansion process is used for driving the compressor for liquefying the non-liquefied fraction of the natural gas.

The pressurized recycle gas is cooled to −70° C. to −100° C. by the first and second refrigerants in the same way as the feed gas. In this case, the recycle gas contains so little C2+fractions, and has such a low critical pressure that it is not prone to partial liquefaction. The recycle gas is then liquefied by a substantially isentropic expansion process, and the non-liquefied fraction of the recycle gas is pressured by a compressor before it is combined with the recycle flow of the natural gas for recycling. The power obtained by the substantially isentropic expansion process is used for driving the compressor for pressurizing the non-liquefied fraction of the recycle gas remaining after the substantially isentropic expansion of the recycle gas.

BRIEF DESCRIPTION OF THE DRAWINGS

Now the present invention is described in the following with reference to the appended drawings, in which.

DETAILED DESCRIPTION OF THE PREFERRED EMBODIMENTS

Figure 1:
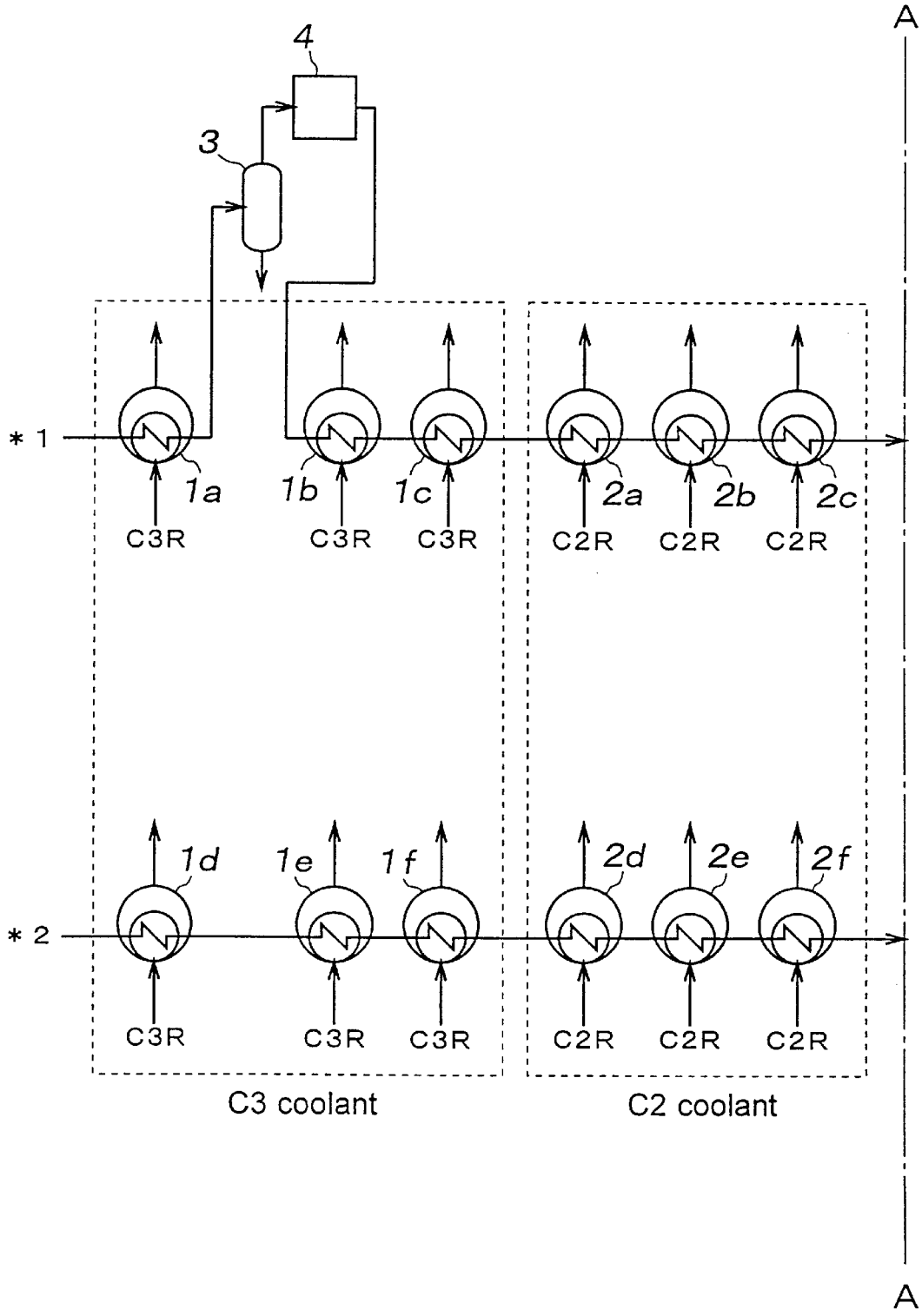
FIG. 1 is a diagram showing one half of a plant which is suitable for implementing the first embodiment of the method for liquefying natural gas according to the present invention.
Figure 2:
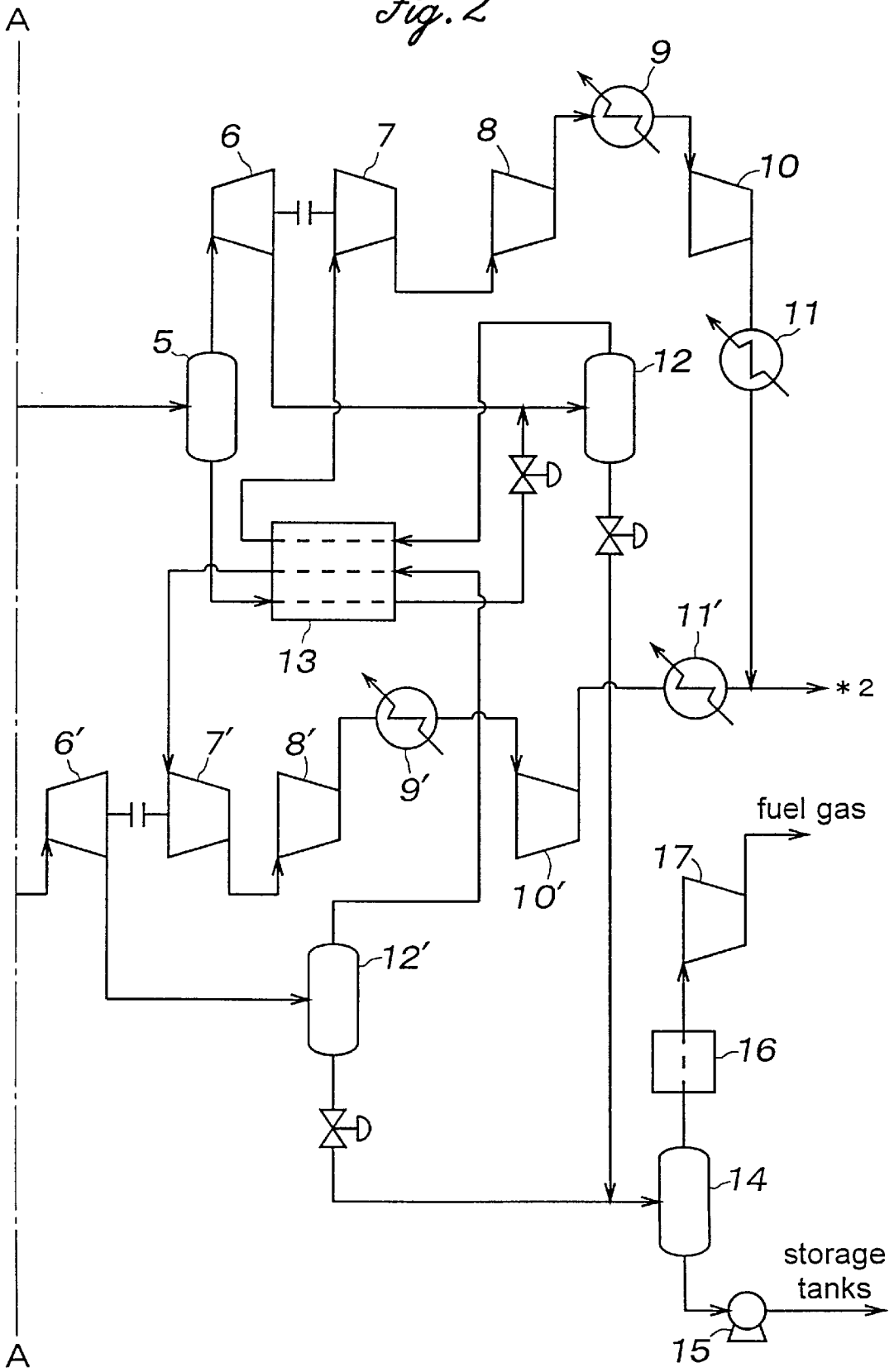
FIG. 2 is a diagram showing the other half of the plant which is suitable for implementing the first embodiment of the method for liquefying natural gas according to the present invention.

FIGS. 1 and 2 show a plant to which a first embodiment of the method for liquefying natural gas of the present invention is applied. Acid gases such as $CO_2$ and $H_2S$ and heavy fraction hydrocarbons of C5 or higher are removed from the high pressure natural gas, and the thus prepared natural gas is introduced into a heat exchanger 1*a* as feed gas *1 at 43 bar and 34° C. The composition of the feed gas is as given in Table 1. The flow rate is 19,000 kg.mol/h.

TABLE 1

| feed natural gas composition (mol %) | |
|---|---|
| $N_2$ | 0.05 |
| $C_1$ | 90.89 |
| $C_2$ | 4.93 |
| $C_3$ | 2.81 |
| $C_4$ | 1.22 |
| $C_5$+ | 0.10 |
| Total | 100.00 |

The feed gas *1 is cooled by a C3 refrigerant (C3R) in three stages. First of all, the feed gas is cooled to approximately 20° C. in a heat exchanger 1*a* by using C3R at 7° C., and most of the water content is condensed and separated in a separation drum 3. The water content is further removed from the feed gas in a dryer 4 to a one weight ppm level, and is introduced into a heat exchanger 1*b* to be cooled to −11° C. by using C3R at −14° C. It is then further cooled to −30° C. in a heat exchanger 1*c* by using C3R at −33° C.

Thereafter, the feed gas is cooled by a C2 refrigerant (C2R) in three stages. First of all, the feed gas is cooled to approximately −45° C. in a heat exchanger 2*a* by using C2R at −48° C., and is introduced into a heat exchanger 2*b* to be cooled to −60° C. by using C2R at −63° C. It is then further cooled to −77.2° C. in a heat exchanger 2*c* by using C2R at −80° C. By this time, approximately 47 mol % of the feed gas is liquefied, and forwarded to an expander inlet drum 5.

Because the fraction of the feed gas which has been liquefied by this precooling process is in the temperature range of −70° C. to −100° C. which is significantly higher than the temperature of the LNG which is−160° C., it is necessary to cool the liquefied fraction of the feed gas to a temperature near that of the LNG. Therefore, the liquefied fraction is cooled in a heat exchanger 13 by exchanging heat with the non-liquefied fractions produced by the two substantial isentropic expansion processes for the natural gas and the recycle gas which are described hereinafter.

Meanwhile, the non-liquefied fraction of the natural gas which has been separated in the expander inlet drum 5 is expanded in a substantially isentropic expansion process by using a turbo-expander 6 to a pressure of approximately 2.7 bar, and cooled to the temperature of −146° C. A part of the flow (18 mol %) is liquefied, and forwarded to an expander outlet drum 12.

The non-liquefied fraction of the natural gas which is separated in the expander outlet drum 12 is introduced into a heat exchanger 13 so that the liquid fraction separated in the expander inlet drum 5 is cooled to −144° C. while the natural gas is warmed to −79° C. The natural gas is thereafter forwarded to a compressor 7 which is directly coupled with the expander 6 to be pressurized to 7.4 bar. The natural gas is then forwarded to a compressor 8, a cooler 9, and a compressor 10, and is pressurized to 71 bar. The natural gas is then cooled to 34° C. in a cooler 11, and is recycled as recycle gas *2.

The recycle gas *2 is passed through three heat exchangers 1*d*, 1*e* and 1*f* having C3 refrigerant C3R circulating therein in three stages, and then through additional three heat exchangers 2*d*, 2*e* and 2*f* having C2 refrigerant C2R circulating therein in three stages, similarly to the feed gas *1 described above, and is cooled to −77° C.

Because the recycle gas which has been thus cooled is relatively free from C2+fractions, it has a relatively low critical pressure, and is not prone to partial liquefaction.

Therefore, the recycle gas is directly introduced into a turbo-expander 6', and is expanded to approximately 1.7 bar and cooled to −148° C. through a substantially isentropic expansion process, and, with a part of the recycle gas (47 mol %) liquefied, is forwarded to an expander outlet drum 12'.

The non-liquefied fraction of the recycle gas which has been separated in the expansion outlet drum 12' is introduced into the heat exchanger 13, and cools the liquid separated in the expander inlet drum 5 while the recycle gas itself is warmed to −79° C. The recycle gas is then pressurized to 7.3 bar by a compressor 7' which is directly coupled with the expander 6', and is passed through a compressor 8', a cooler 9', and a compressor 10'. The recycle gas which is pressurized to 71 bar by the compressor 10' is cooled to 34° C. in a cooler 11', and after joining with the non-liquefied fraction of the natural gas forwarded from the cooler 11, is recycled to the heat exchanger 1*d* as recycle gas *2.

The liquid fraction which has been separated in the expander inlet drum 5 and cooled in the heat exchanger 13 is depressurized by a valve and introduced into the expander outlet drum 12. The liquid from the expander outlet drum 12 and the liquid from the expander outlet drum 12' are depressurized by respective valves to 1.3 bar, and cooled to −157° C. The combined flow is then introduced into a flash drum 14 to be separated into LNG and lean gas, and, at the same time, $N_2$ carried over from the original natural gas is removed.

The lean gas separated in the flash drum 14 is passed through a heat exchanger 16 to recover the cold therefrom, and used as fuel gas after being pressurized by a compressor 17 having the capacity of 1,440 kg.mol. The liquid separated in the flash drum 14 is delivered by a pump 15 to storage tanks at the rate of 321 tons per hour as LNG.

Figure 3:
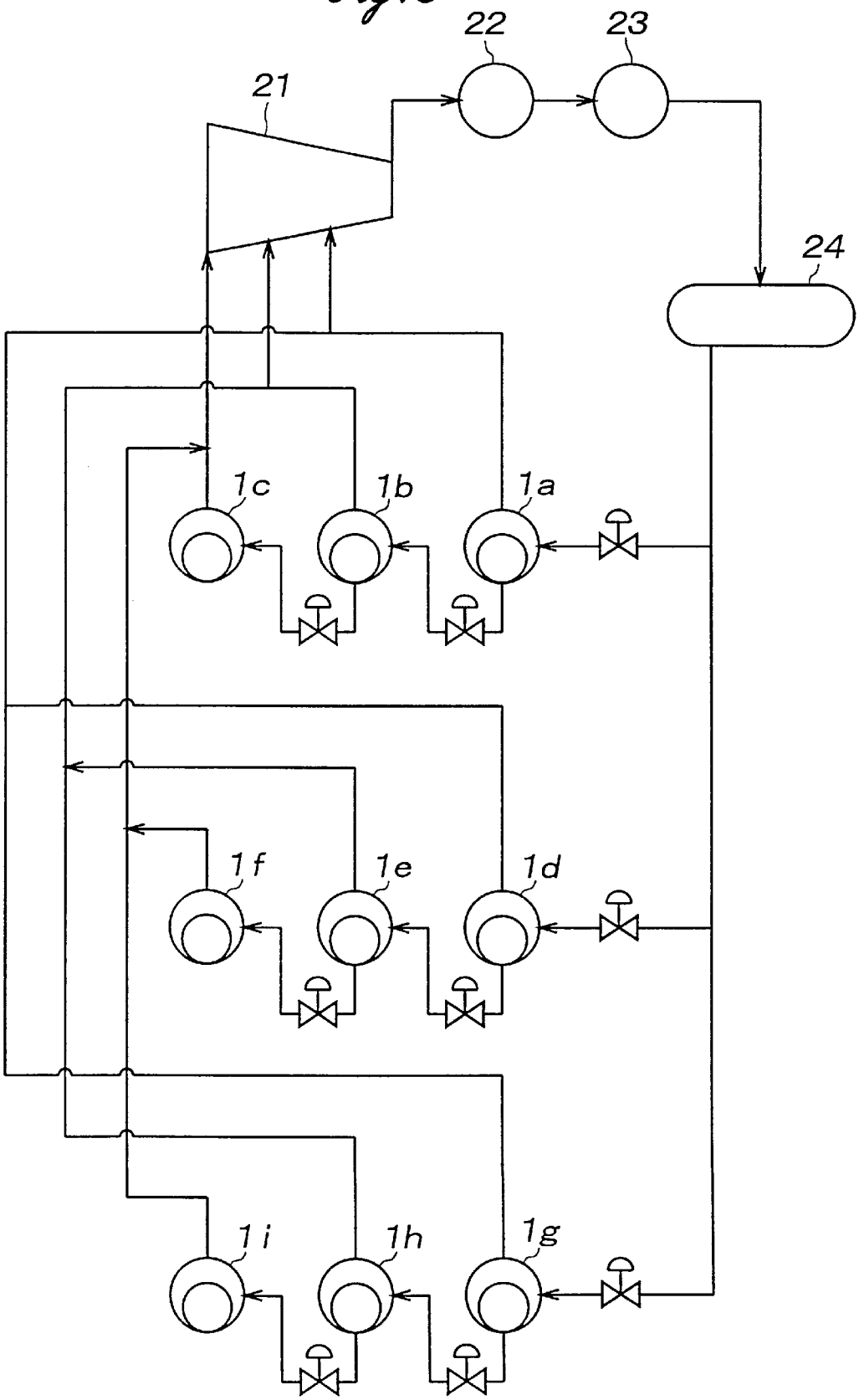
FIG. 3 is a diagram showing the refrigeration cycle for the C3 refrigerant.

FIG. 3 shows the refrigeration cycle for the C3 refrigerant. The C3 refrigerant is stored in a drum 24 at 37° C. and 13 bar in the form of liquid. The C3R liquid from this drum 24 is introduced into the heat exchangers 1*a*, 1*b* and 1*c* for precooling the feed gas, and the heat exchangers 1*d*, 1*e* and 1*f* for precooling the recycle gas. It is also introduced into the heat exchangers 1*g*, 1*h* and 1*i* for a C2 refrigerant refrigeration cycle which is described hereinafter. The C3R liquid from the drum 24 is depressurized to 7° C. and 5.9 bar by valves before being introduced into these heat exchangers, and produces 23% of vapor.

A part of the liquid introduced into the heat exchanger 1*a* vaporizes, and cools the feed gas. The remaining liquid is depressurized to −14° C. and 3 bar by a valve, and produces 14% of vapor before it is introduced into the heat exchanger 1*b*. In the heat exchanger 1*b*, a part of the liquid vaporizes and further cools the feed gas while the remaining liquid is depressurized to −33° C. and 1.5 bar by a valve, and produces 10% of vapor before it is introduced into the heat exchanger 1*c*. In the heat exchanger 1*c*, the liquid entirely evaporates, and further cools the feed gas. Similarly, C3R vapor is produced in the heat exchangers 1*d*, 1*e* and 1*f*, and the heat exchangers 1*g*, 1*h* and 1*i*. The C3R vapor from the heat exchangers 1*a* to 1*i* is forwarded to a C3 compressor 21 via different channels for different stages.

The C3R vapor is pressurized to 14 bar by the C3 compressor 21, and after being cooled to near the condensation temperature of 37° C. by a de-superheater 22, is condensed in a C3 condenser 23. The condensate is returned to the drum 24 to complete the refrigeration cycle.

Figure 4:
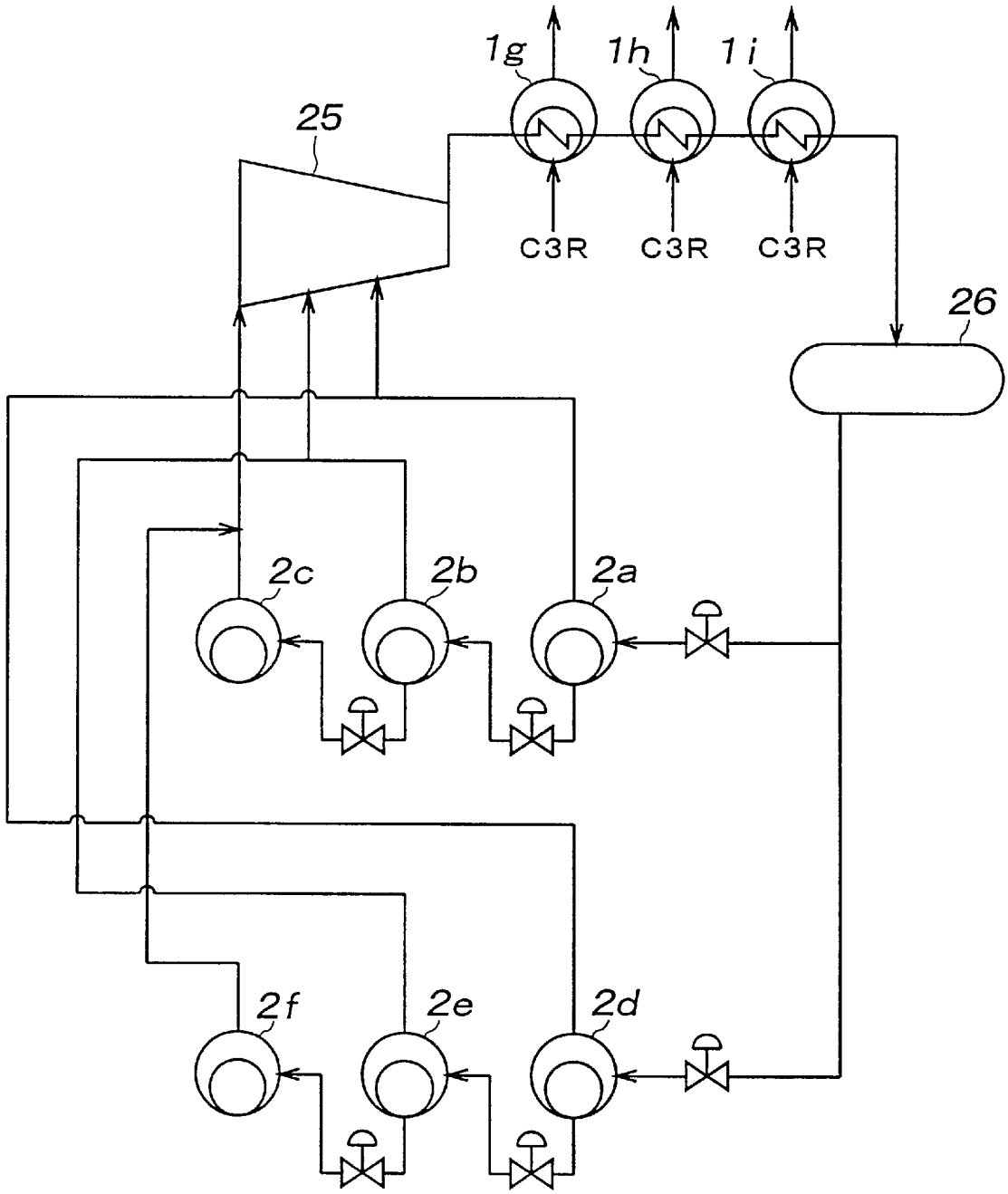
FIG. 4 is a diagram showing the refrigeration cycle for the C2 refrigerant.

FIG. 4 shows the refrigeration cycle for the C2 refrigerant. The C2 refrigerant (C2R) is stored in a drum 26 at −30 ° C. and 11 bar in the form of liquid. The C2R liquid from this drum 26 is introduced into the heat exchangers 2*a*, 2*b* and 2*c* for precooling the feed gas, and the heat exchangers 2*d*, 2*e* and 2*f* for precooling the recycle gas. The C2R liquid from the drum 26 is depressurized to −48° C. and 6.0 bar by a valve before being introduced into these heat exchangers, and produces 12% of vapor.

A part of the liquid introduced into the heat exchanger 2*a* vaporizes, and cools the feed gas. The remaining liquid is depressurized to −63° C. and 3.4 bar by a valve, and produces 9% of vapor before it is introduced into the heat exchanger 2*b*. In the heat exchanger 2*b*, a part of the liquid vaporizes and further cools the feed gas while the remaining liquid is depressurized to −80° C. and 1.55 bar by a valve, and produces 9% of vapor before it is introduced into the heat exchanger 2*c*. In the heat exchanger 2*c*, the remaining liquid entirely evaporates, and further cools the feed gas. Similarly, the C2 refrigerant cools the recycle gas in the heat exchangers 2*d*, 2*e* and 2*f*, and produces C2R vapor. The C2R vapor from the heat exchangers 2*a* to 2*f* is forwarded to a C2 compressor 25 via different channels for different stages.

The C2R vapor is pressurized to 11 bar by the C2 compressor 25, and after being cooled in the heat exchangers 1*g* and 1*h* by the C3 refrigerant and in the heat exchanger 1*i* by the C3 refrigerant, is entirely condensed. The condensate is introduced into the drum 26 to complete the refrigeration cycle.

Table 2 shows the power requirements (MW) of the expanders and compressors for the first embodiment of the present invention.

TABLE 2

| Power Requirements (MW) | |
|---|---|
| expander 6 | 5.5 |
| expander 6' | 6.1 |
| total | 11.6 |
| compressor 8, compressor 8', compressor 9, compressor 9' | 35.24 |
| compressor 21 | 35.90 |
| compressor 25 | 14.46 |
| total | 85.60 |

Figure 5:
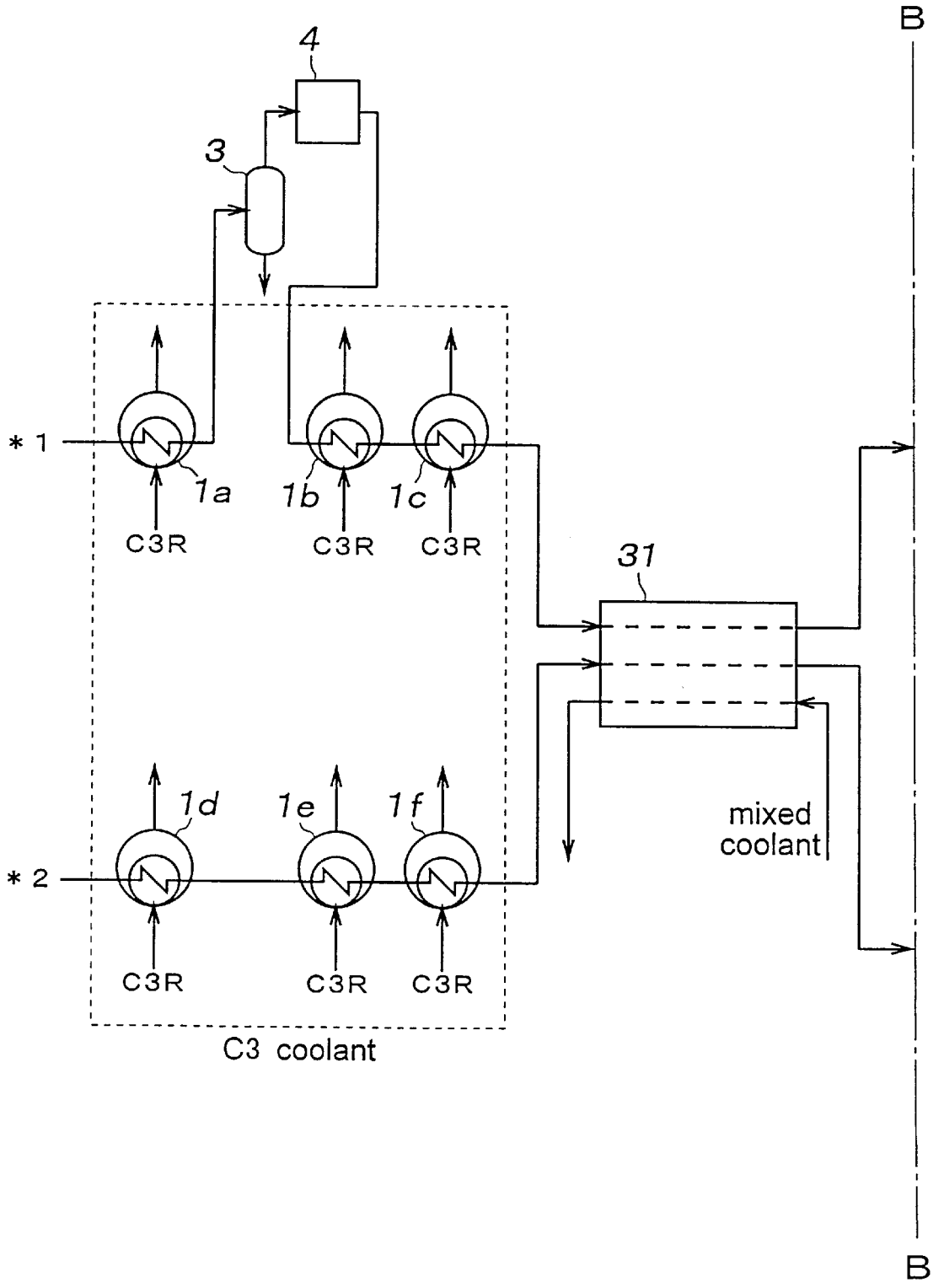
FIG. 5 is a diagram showing one half of a plant which is suitable for implementing the second embodiment of the method for liquefying natural gas according to the present invention.
Figure 6:
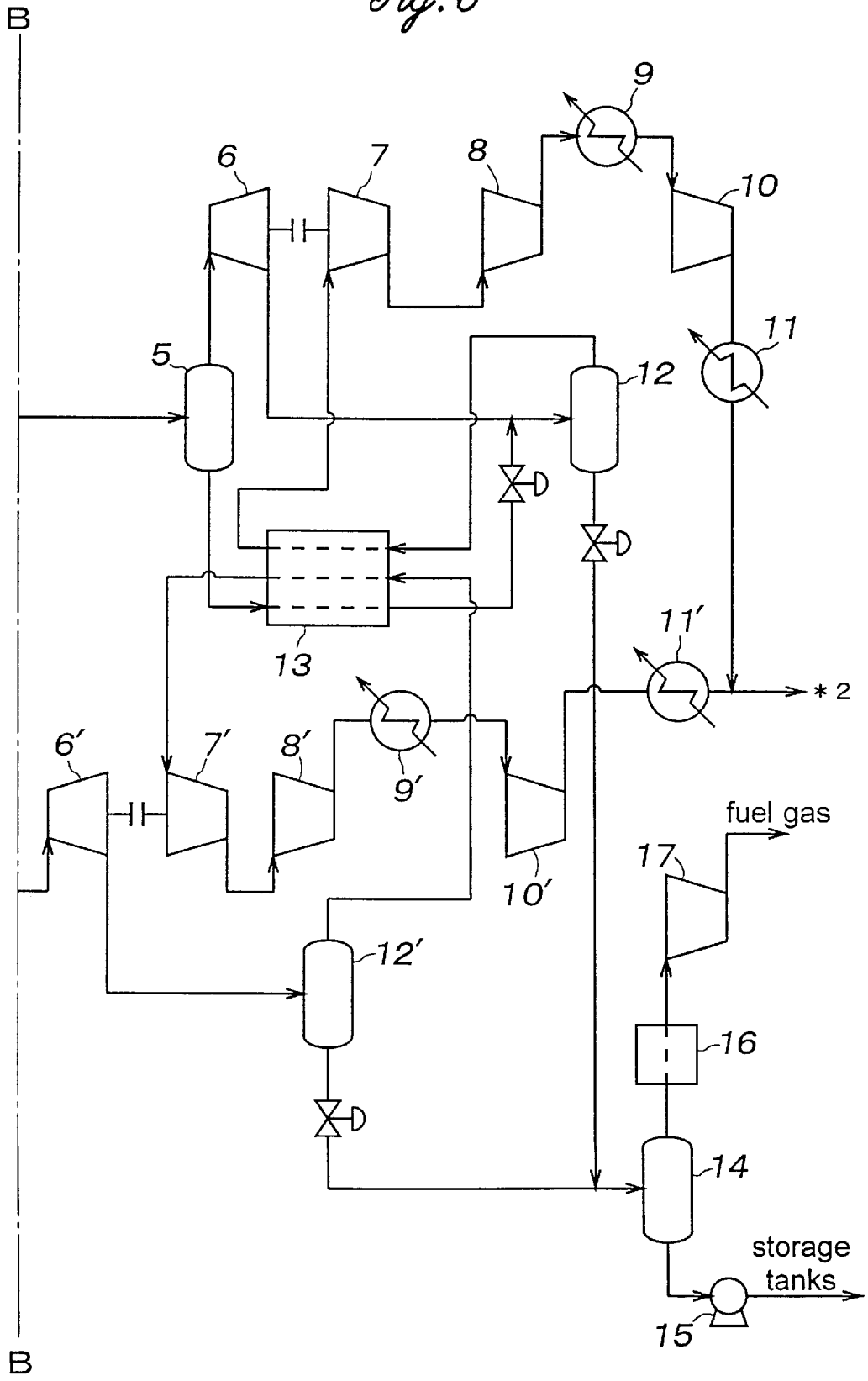
FIG. 6 is a diagram showing the other half of the plant which is suitable for implementing the second embodiment of the method for liquefying natural gas according to the present invention.

FIGS. 5 and 6 show a plant to which a second embodiment of the present invention is applied. The second refrigerant consists of a mixed refrigerant consisting of C1, C2 and C3, and a mixed refrigerant heat exchanger 31 is used instead of the heat exchangers 2*a* to 2*f* using the C2 refrigerant in the first embodiment. The second embodiment is otherwise identical to the first embodiment, and corresponding parts are denoted with like numerals. The composition of the mixed refrigerant (mol %) is as given in Table 3.

TABLE 3

| Composition of Mixed Refrigerant (mol %) | |
|---|---|
| C1 | 10 |
| C2 | 60 |

TABLE 3-continued

| Composition of Mixed Refrigerant (mol %) | |
|---|---|
| C3 | 25 |
| C4 | 5 |
| Total | 100 |

Figure 7:
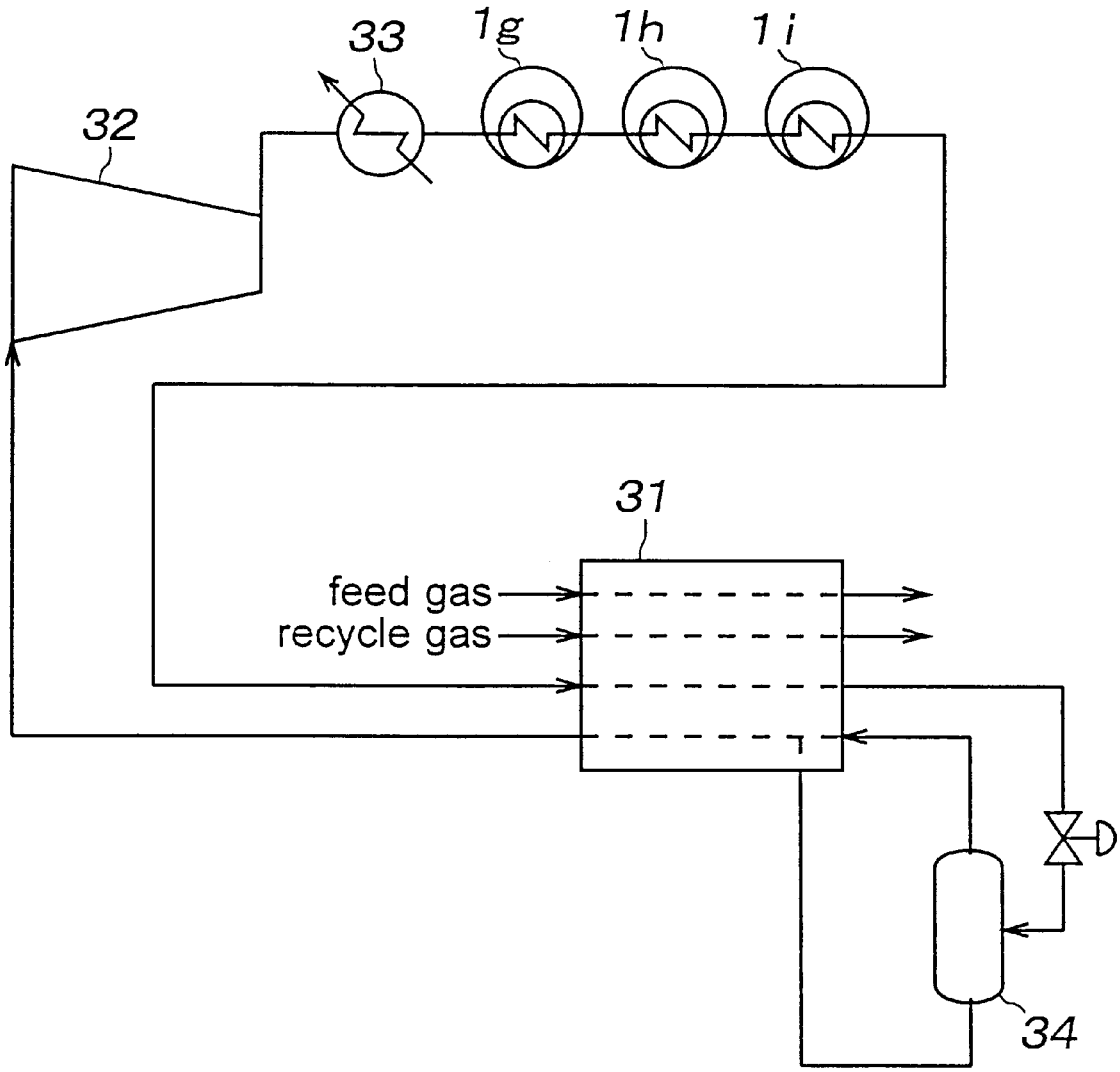
FIG. 7 is a diagram showing the refrigeration cycle for the mixed refrigerant.
Figure 8:
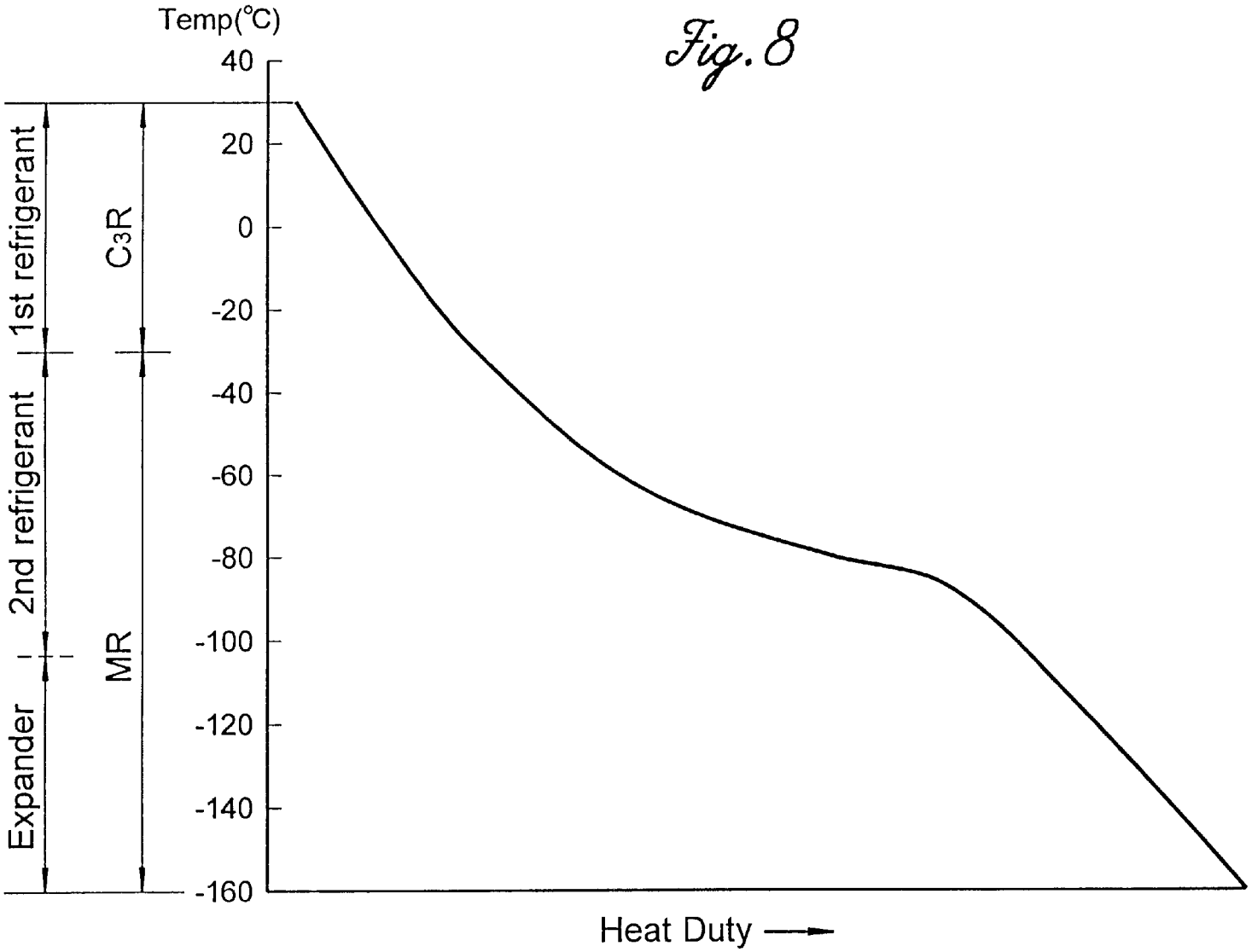
FIG. 8 is a diagram associating the temperature ranges with the cooling means for both the present invention and the conventional mixed-refrigerant refrigeration cycle.

The mixed refrigerant vapor, which has left the mixed refrigerant heat exchanger 31 is at −33° C. and 2 bar, is pressurized to 18 bar by a mixed refrigerant compressor 32 as illustrated in FIG. 7, and cooled to 34° C. by a cooler 33. This flow is cooled to −30° C. and liquefied in the heat exchangers 1*g*, 1*h* and 1*i* through which C3R circulates in three stages. The flow is further cooled to −77° C. by the mixed refrigerant heat exchanger 31 along with the feed gas and the recycle gas, and is depressurized and cooled to 2.1 bar and −80° C. by a valve, before it is returned to the heat exchanger 31 via a flash drum 34. In the heat exchanger 31, the mixed refrigerant evaporates while cooling the feed gas, the recycle gas and the high pressure mixed refrigerant to −77° C.

Table 4 shows the power requirements (MW) of the expanders and compressors for the second embodiment of the present invention.

TABLE 4

| Power Requirements (MW) | |
|---|---|
| expander 6 | 5.5 |
| expander 6' | 6.1 |
| total | 11.6 |
| compressor 8, compressor 8', compressor 9, compressor 9' | 35.24 |
| compressor 21 | 26.60 |
| compressor 25 | 22.90 |
| total | 84.74 |

As can be appreciated from the above description, according to the present invention, because the precooling process by a refrigerant can be carried out in a relatively inexpensive heat exchanger such as a shell and tube heat exchanger or a plate fin heat exchanger, and the final cooling process can be carried out by using an expansion cycle, for instance, using a turbo-expander, the present invention can be applied to LNG plants of a wide range of capacity without requiring any expensive or special heat exchanger. Furthermore, by carrying out liquefaction and cooling processes by using first and second refrigerants and in stepwise fashion, the number of components in the refrigerants may be reduced, and the refrigerants may be produced by using economical refrigerant production facilities so that a significant improvement can be made in increasing the efficiency and reducing the cost of the liquefaction process for natural gas. The first refrigerant may consist of a single-component propane or propylene refrigerant, or a mixed refrigerant containing ethane, ethylene, propane and propylene. The second refrigerant may consist of a single-component ethane or ethylene refrigerant, or a mixed refrigerant essentially consisting of low temperature fraction hydrocarbons such as methane, ethane, ethylene, propane and propylene. Thus, even when the gas field for the LNG plant does not yield any significant amount of C5 fractions, the refrigerant can be produced within the LNG plant, and this also adds to the advantage of the present invention.

Although the present invention has been described in terms of preferred embodiments thereof, it is obvious to a person skilled in the art that various alterations and modifications are possible without departing from the scope of the present invention which is set forth in the appended claims.

What we claim is:

1. A method for liquefying natural gas, comprising the steps of:

a) precooling the natural gas in multiple cooling stages using a single-component refrigerant;

b) subsequent to step a), precooling the natural gas in multiple cooling stages using a mixed refrigerant;

c) subsequent to step b), substantially isentropically expanding the precooled natural gas to obtain a first liquefied fraction and a first non-liquefied fraction;

d) passing the first non-liquefied fraction through at least one compressor, the one compressor being driven by said substantially isentropic expansion, to provide a recycle gas;

e) precooling the recycle gas in multiple cooling stages using a single component refrigerant;

f) subsequent to step e), precooling the recycle gas in multiple cooling stages using a mixed refrigerant; and g) subsequent to step f) expanding the recycle gas substantially isentropially, to obtain second liquefied and non-liquefied fractions.

2. A method according to claim 1 wherein said precooling in steps a) and b) results in a partial liquefaction of the natural gas.

3. A method according to claim 1 wherein the single-component refrigerant is propane or propylene.

4. A method according to claim 1 wherein the mixed refrigerant includes plural refrigerants selected from the group consisting of ethane, ethylene, propane and propylene.

5. A method according to claim 1 wherein the same single-component refrigerant is used in all cooling stages of step a).

6. A method according to claim 1 wherein the same mixed refrigerant is used in all cooling stages of step b).

7. A method according to claim 1 wherein the same single-component refrigerant is used in all cooling stages of steps a) and e) and the same mixed refrigerant is used in all stages of steps b) and f).

8. A method according to claim 1 wherein the cooling stages of steps a) and b) are separate from the cooling stages of steps g) and f) and the expansion of step c) is conducted separately from the expansion of step g).

9. A method for liquefying natural gas, comprising the steps of:

a) precooling the natural gas in multiple cooling stages using a single-component refrigerant;

b) subsequent to step a), precooling the natural gas in multiple cooling stages using a mixed refrigerant;

c) subsequent to step b), substantially isentropically expanding the precooled natural gas to obtain a first liquefied fraction and a first non-liquefied fraction;

d) passing the first non-liquefied fraction through at least one compressor, the one compressor being driven by said substantially isentropic expansion, to provide a recycle gas;

e) precooling the recycle gas in multiple cooling stages using a single component refrigerant;

f) subsequent to step e), precooling the recycle gas in multiple cooling stages using a mixed refrigerant;

g) subsequent to step f) expanding the recycle gas substantially isentropially, to obtain second liquefied and non-liquefied fractions, and h) passing the second non-liquefied fraction through a second compressor, the second compressor being driven by the substantially isentropic expansion of step g).

10. A method according to claim 9 wherein said precooling in steps a) and b) results in a partial liquefaction of the natural gas.

11. A method according to claim 9 wherein the single-component refrigerant is propane or propylene.

12. A method according to claim 9 wherein the mixed refrigerant includes plural refrigerants selected from the group consisting of ethane, ethylene, propane and propylene.

13. A method according to claim 9 wherein the same single-component refrigerant is used in all cooling stages of step a).

14. A method according to claim 9 wherein the same mixed refrigerant is used in all cooling stages of step b).

15. A method according to claim 9 wherein the same single-component refrigerant is used in all cooling stages of steps a) and e) and the same mixed refrigerant is used in all stages of steps b) and f).

16. A method according to claim 9 wherein the cooling stages of steps a) and b) are separate from the cooling stages of steps g) and f) and the expansion of step c) is conducted separately from the expansion of step g).

* * * * *

UNITED STATES PATENT AND TRADEMARK OFFICE

CERTIFICATE OF CORRECTION

PATENT NO. : 6,062,041
DATED : May 16, 2000
INVENTOR(S) : Kikkawa et al

It is certified that error appears in the above-identified patent and that said Letters Patent is hereby corrected as shown below:

Column 1,
Line 45, "shift" should read -- shell --.

Column 2,
Line 11, after "range" insert -- of 80°C - 160°C, respectively, when cooling the natural gas
from room --.

Signed and Sealed this

Twenty-third Day of October, 2001

*Attest:*

Nicholas P. Godici

NICHOLAS P. GODICI
*Acting Director of the United States Patent and Trademark Office*

*Attesting Officer*